US008172708B2

(12) United States Patent
Burke

(10) Patent No.: US 8,172,708 B2
(45) Date of Patent: May 8, 2012

(54) INFLATION METHOD FOR AND GAME BALL WITH NOISE SUPPRESSION DISK

(75) Inventor: Dann Burke, Reno, NV (US)

(73) Assignee: Tachikara USA, Inc., McCarran, NV (US)

( * ) Notice: Subject to any disclaimer, the term of this patent is extended or adjusted under 35 U.S.C. 154(b) by 0 days.

(21) Appl. No.: 13/239,020

(22) Filed: Sep. 21, 2011

(65) Prior Publication Data

US 2012/0006447 A1 Jan. 12, 2012

Related U.S. Application Data

(62) Division of application No. 12/397,916, filed on Mar. 4, 2009, now Pat. No. 8,029,394.

(51) Int. Cl.
*A63B 41/00* (2006.01)

(52) U.S. Cl. ..... 473/594

(58) Field of Classification Search ..... 473/594, 473/570, 571, 595, 610; 156/146, 147, 170, 156/172, 245
See application file for complete search history.

(56) References Cited

U.S. PATENT DOCUMENTS

| | | | | |
|---|---|---|---|---|
| 2,499,483 | A | | 3/1950 | Foy |
| 2,519,248 | A | | 8/1950 | Hulbert |
| 2,645,486 | A | | 7/1953 | Monahan |
| 3,755,820 | A | | 9/1973 | Petrusek et al. |
| 3,900,638 | A | | 8/1975 | Du Bato |
| 3,954,269 | A | | 5/1976 | Brittingham |
| 4,098,504 | A | | 7/1978 | Koziol et al. |
| 4,166,484 | A | | 9/1979 | Reed |
| 4,248,275 | A | * | 2/1981 | Reed ..... 141/4 |
| 4,300,767 | A | | 11/1981 | Reed et al. |
| 4,340,626 | A | | 7/1982 | Rudy |
| 4,358,111 | A | | 11/1982 | Papinsick et al. |
| 4,358,487 | A | | 11/1982 | Walker |
| 4,513,803 | A | | 4/1985 | Reese |
| 5,227,103 | A | | 7/1993 | Muschiatti |
| 5,254,026 | A | | 10/1993 | Kaiser |
| 5,342,043 | A | | 8/1994 | Baltronis et al. |
| 5,356,430 | A | | 10/1994 | Nadol, Jr. |
| 5,672,089 | A | | 9/1997 | Piera Bermejo |
| 5,749,799 | A | | 5/1998 | Jasperson |
| 6,048,591 | A | | 4/2000 | Zwiebel |
| 6,167,841 | B1 | | 1/2001 | Ho |
| 6,217,956 | B1 | | 4/2001 | Heidkamp |
| 6,457,263 | B1 | | 10/2002 | Rudy |
| 7,188,652 | B2 | | 3/2007 | Yukawa |
| 7,740,551 | B2 | * | 6/2010 | Nurnberg et al. ..... 473/570 |
| 8,029,394 | B2 | * | 10/2011 | Burke ..... 473/594 |
| 2005/0277499 | A1 | | 12/2005 | Tang et al. |
| 2006/0205547 | A1 | | 9/2006 | O'Neill et al. |

* cited by examiner

*Primary Examiner* — Steven Wong
(74) *Attorney, Agent, or Firm* — SilverSky Group, LLC

(57) ABSTRACT

An inflatable game ball containing a noise suppression device and a method for inflating the game ball are described. More particularly, a free standing, noise suppression disk is fit snuggly within a central area of the hollow internal cavity formed by the bladder of the game ball. The diameter of the noise suppression disk is slightly larger than the diameter of the hollow internal cavity of the ball, while the thickness of the disk is sufficient to provide necessary rigidity to the game ball noise suppressor without adding excess weight to the ball. An exact amount of $SF_6$ is pre-filled in the balls, when combined with subsequent air, is determined to create the ultimate $SF_6$ to air ratio range at various altitude levels. Subsequently, the balls are only partially inflated at the time of manufacture with the $SF_6$ gas, and no air.

20 Claims, 2 Drawing Sheets

INFLATION METHOD FOR AND GAME BALL WITH NOISE SUPPRESSION DISK

CROSS-REFERENCES TO RELATED APPLICATIONS

This is a divisional patent application, taking priority from U.S. patent application Ser. No. 12/397,916, filed Mar. 4, 2009 now U.S. Pat. No. 8,029,394, which is incorporated herein by reference in its entirety.

BRIEF DESCRIPTION OF THE INVENTION

The present invention relates to a reduced noise game ball that will remain inflated over a longer period of time. More specifically, the present invention provides a game ball, inflated with a low permeability gas mixture, containing a freestanding noise suppression disk in the hollow internal cavity of the ball. The invention also relates to a method for partially inflating a game ball with a low permeability gas, such as sulfur hexafluoride ($SF_6$), at manufacture so the ball can be shipped only partially inflated, and subsequently inflating the game ball completely with air at the point of retail or prior to use to achieve its regulation weight and pressure tolerances between altitudes at sea level to 8,000 feet. This inflation method extends the life of properly pressurized game balls by delaying full inflation, which activates the permeation of gas molecules.

STATEMENT AS TO THE RIGHTS TO INVENTIONS MADE UNDER FEDERALLY SPONSORED RESEARCH OR DEVELOPMENT

Not Applicable.

REFERENCE TO A "SEQUENCE LISTING," A TABLE, OR A COMPUTER PROGRAM LISTING APPENDIX SUBMITTED ON A COMPACT DISK

Not Applicable.

BACKGROUND OF THE INVENTION

Roughly speaking, the second law of thermodynamics states that higher energy states move toward lower energy states; in simpler terms, differences in temperature, density and pressure want to even out. This is why articles such as balloons, tires and game balls inflated with air tend to go flat. Gas molecules under higher pressure within an inflated article aim to reach pressure equilibrium with air molecules surrounding the article until pressure equilibrium is reached. The air is set in motion by a pressure gradient force produced when air with different pressures are adjacent to one other.

A decrease in an article's inflation pressure causes the article to go flat thereby compromising the article's integrity and performance. Inflation pressures in articles may be lost, in part, due to seepage of gas molecules through the articles' surrounding cavity membrane or through their inflation valves. The loss of an article's inflation pressure through the membrane may be due to seam defects, defective materials or faulty constructive techniques of the article. In most cases, however, articles inflated with air lose pressure over time due to the small size of the molecules comprising air, which primarily includes the elements nitrogen and oxygen. These small molecules easily permeate the cavity membrane and gradually escape, thereby reducing pressure within the article.

Because of its availability, low cost, relative safety, and ease of use for inflation, air has been the most commonly used substance to inflate game balls requiring a gas fill. However, to combat loss of inflation pressure due to the permeation of small gas molecules through the membrane of a ball, inflation systems made up of larger, low permeability molecules such as fluoropropane ($C_3F_8$), hexafluoroethane ($C_2F_6$), and monochlorotrifluoromethane ($CClF_3$) have been examined.

An alternate inflation system exhibiting improved pressure retention properties was disclosed by Koziol et al. in U.S. Pat. No. 4,098,504.The inflation system comprises a mixture of air and sulfur hexafluoride ($SF_6$). Compared to other large molecule systems examined previously, $SF_6$ was found to be substantially more suitable than other low permeability gases in terms of extended pressure retention, material cost, safety and availability.

However, an undesirable attribute of the use of the air and $SF_6$ inflation system of Koziol in game balls, as well as with the use of other low permeability gas systems, is that balls in which it is used produce on impact, for example bouncing or striking the ball, unpleasant resonant frequencies described in the art as a pinging or ringing sound. While in no way interfering with the playability of the ball, many users considered the sound to be a distracting and annoying, thereby rendering the ball unsuitable for play.

In an attempt to ameliorate the noise resulting from the use of the air and $SF_6$ inflation medium in a game ball, Reed et al. (U.S. Pat. No. 4,300,767) introduced free-moving materials to the cavity of a tennis ball to disturb the sonic resonance causing the "ping." The materials tested as "ping" dampeners included: vermiculite, rubber dust, and foam and rubber cubes. Reed et al. discovered that the density of the materials made little difference on their performance as anti-ping materials; in fact, solid rubber samples of adequate size ($\geqq$1.2 cm cube) were effective. Reed et al. also found that metals, foam, dense rubber, fibers, and powders were all effective in reducing the "ping" noise if their volumes were large enough.

Ultimately, Reed et al. determine that a cube made of foam is the preferred "ping" suppression material and device. Although the cubed materials were found to adequately ameliorate the "ping" sound in tennis balls, the unattached free-moving cube compromises the playability of the ball. First, the free-moving cube inside the cavity of the ball alters the symmetry of the ball and could cause the ball to curve in midflight thereby changing its trajectory. Even a slight weight displacement can influence the ball's trajectory, which would be distorted even more so when a larger sized cube of greater weight was used. Second, although the movement and collisions of a free-moving cube in the cavity of a tennis ball may not be noticeable to one striking the ball with a racquet, a player is certain to feel the movement and collisions of an unattached cube in the cavity of a volleyball as it is set or received during play, or a basketball as it is caught or dribbled, or other handballs as they are used for other sports.

Furthermore, an unattached cube will no doubt wear down as it bangs around the cavity of the ball during play. The corners of the cube will round off, thereby decreasing its volume and changing its shape. As a result, over time the cube loses its "ping" dampening effectiveness prematurely with continued play.

Moreover, the cube in Reed et al. was disclosed only to work in a tennis ball. Scaling up this technology to work within a volleyball or a comparably sized ball would add significant weight to the game ball. The official weight, Pressure per Square Inch (PSI), and size of the ball is very tightly regulated by the various leagues and organizations that use the balls, such as the National Federation of State High School Associations, the National Collegiate Athletic Association, USA Volleyball, other Olympic teams, the Federation International de Volleyball, and other clubs, leagues, etc. As a result, weight equal in amount to that added by the noise dampening device as well as the $SF_6$ must be removed from other components of the ball to offset their added weight. This can be accomplished by changing the material used for the interior surface of the exterior shell when an artificial shell material is used (the exterior surface itself is hard to change because it is meant to simulate leather or must be leather), using a thinner layer of leather, using a lighter bladder, or using a lighter valve assembly on the bladder. However, there is only so much that can be removed or changed in these sections and it may ultimately be impossible to fully compensate for the added weight of the cube and the $SF_6$.

To account for the shortcomings in Reed et al., O'Neill et al. developed a technique described in U.S. patent application Ser. No. 11/363,618,whereby one or more acoustic pads were adhered to the interior wall of a game ball, such that the internal symmetry of the ball was not disrupted. The acoustic material preferably conforms to the internal symmetry of the ball and absorbs noise in the highest intensity region of the ball's inner cavity.

However, depending on the type of material used in construction, such pads may add the equivalent of a full layer of material to the ball in order to adequately muffle the noise while maintaining the internal symmetry of the ball. Adding that much acoustic material to a ball creates two problems. First, the pads and their adhesive add additional weight to the ball; and second a more complicated and time-consuming assembly process is necessary to construct the ball. Even if a smaller number of pads are added to the ball, it will still be necessary to glue or otherwise adhere the pads to an interior surface of the ball, which will increase the cost of components for the balls and more significantly increase the cost of manufacture. Adhesives also add unwanted weight to the ball.

Conventionally, game balls requiring a gas fill are inflated, if at all, either at the time of manufacture prior to shipping or by clerks at the individual retail stores. A ball that is filled completely with a large molecule gas system at the time of manufacture, such as those disclosed in Reed et al. and in O'Neill et al., is already compromised with regard to its longevity. Because the pressure within the ball is greater than the atmospheric pressure, the ball will naturally attempt to seek equilibrium, thereby forcing the smaller molecules of the gas used to inflate the ball to permeate the membrane of the wall to escape the higher pressure. Even when the gas filling the ball is comprised of larger molecules, those molecules will eventually find their way past the ball's membrane, causing it to lose pressure. This process is accelerated since Reed et al. and O'Neill et al. use a gas mix ratio that includes air, which is largely comprised of smaller molecules. A typical manufacturing to the end user time line is as follows:

Balls manufactured and stored at the manufacturer until ready for shipment—approximately one month;

Balls shipped to shipping company for transport to national distributor and to go through customs—approximately one to two months, including shipping (usually by cargo ship overseas);

Balls received by national distributor and warehoused pending orders from individual retail stores—one to three months;

Balls received by stores and stored in backroom until shelf space is available and ball is sold to an end user—one to three months.

Hence, the total amount of time that can pass between when a ball is manufactured and when it is finally purchased by an end user/consumer can range anywhere from seven months to eighteen months. Thus, significantly reducing properly pressurized retail shelf-life. The O'Neill et al. ball, which is inflated at the time of manufacture and is presently licensed to Spalding, provides a warranty to retain its inflated state for only a period of one year, which may have largely been passed before the ball is even purchased by an end user/consumer.

Furthermore, when a ball is inflated completely at the time of manufacture, it requires more container space during shipping, more warehouse space during distribution and warehousing, and more backroom shelf space at the retail store. All of this space costs money, increases the cost of shipping and distributing the balls on a per ball basis, and reduces the life expectancy of the balls.

On the other hand, balls that are shipped completely uninflated run the risk of having their internal bladders seal shut during the long period between when they are manufactured and when they are finally inflated completely at a retail store. In addition, a completely un-inflated bladder is difficult for a retail clerk to fill without damaging the bladder from poking a pump needle through a wall of the bladder.

By partially inflating the balls at the place of manufacture prior to shipping, it would appear that the problems of the two extremes described above would be resolved. And, if the fill gas was air only, they would be. Hence, many air filled balls are shipped partially inflated. However, for game balls that feature a low permeability gas, such as $SF_6$, as a fill component, the balls must be shipped fully pressurized and inflated because retail stores and end users do not have ready access to low permeability gases.

DETAILED DESCRIPTION OF THE INVENTION

The present invention provides a game ball, inflated with a low permeability gas mixture, containing a freestanding noise suppression disk in the hollow internal cavity of the ball. The invention also relates to a method for partially inflating a game ball through the gas fill valve with a low permeability gas, such as sulfur hexafluoride ($SF_6$), at manufacture, and subsequently inflating the game ball completely with air at the point of retail to achieve its regulation weight, gas mix range, and pressure tolerances between altitudes at sea level to 8,000 feet.

Figure 1:
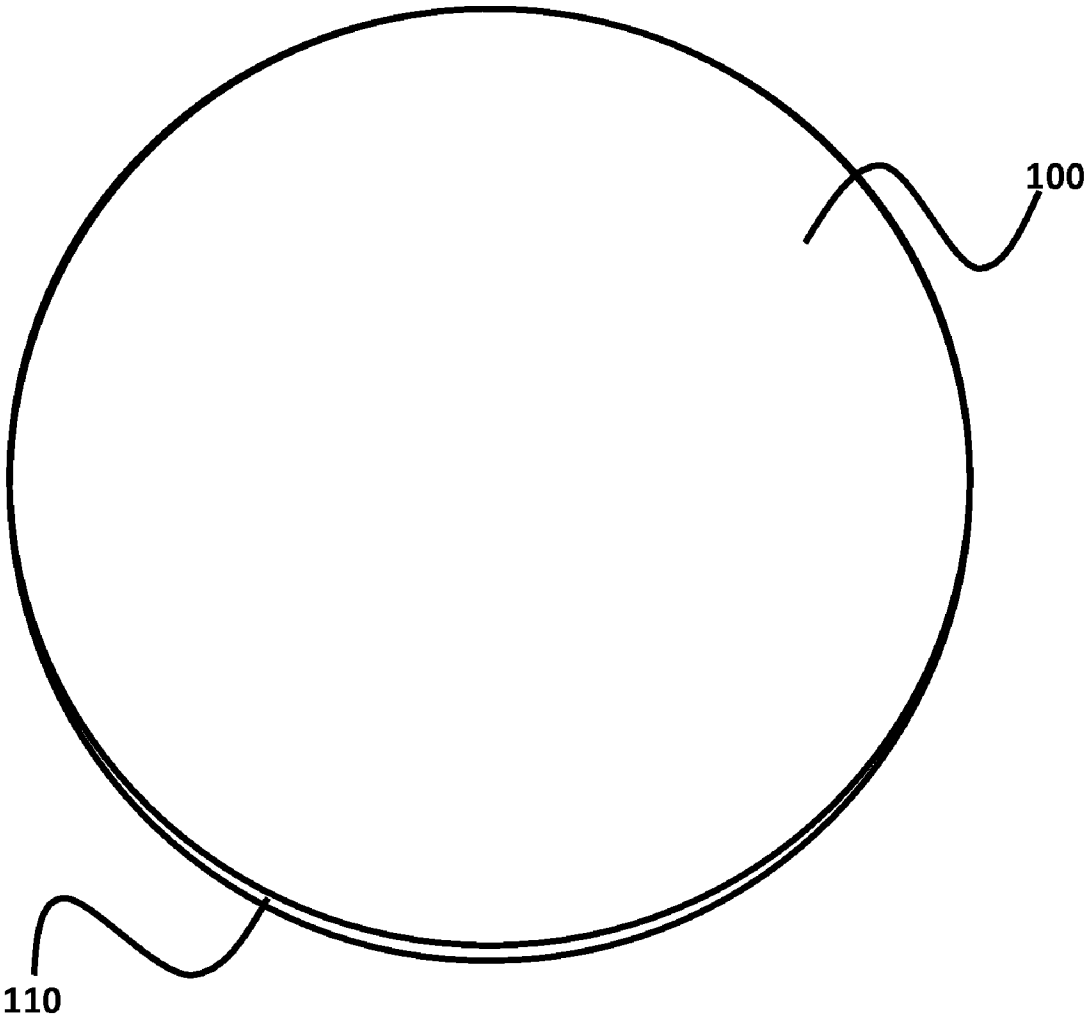
FIG. 1 is a depiction of a preferred embodiment of the noise suppression disk.

A preferred embodiment of the game ball noise suppressor 100, having a thickness illustrated by 110, is illustrated in FIG. 1. In the preferred embodiment, the game ball noise suppressor 100 is disk shaped and formed of open-cell foam made from a polyether; however, the game ball noise suppressor 100 can be made of any other material that can suppress the undesirable sound, such as rubber, leather, various fibrous materials, various plasticized materials, cardboard, paper, etc. While the present invention may be used with any inflatable game ball, it is described here in conjunction with a volleyball for sake of convenience.

Figure 2:
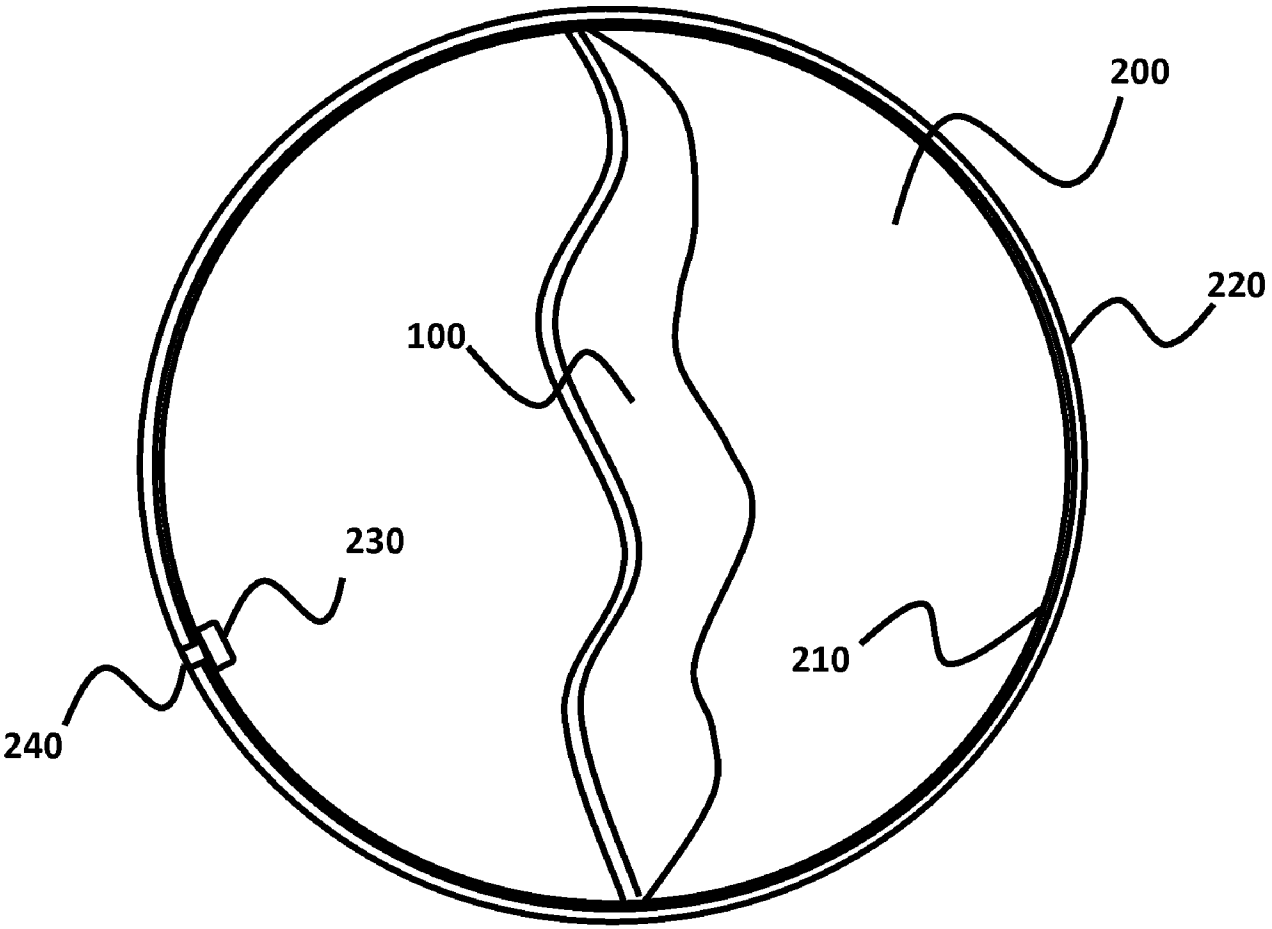
FIG. 2 is a cross-sectional view of a game ball showing the noise suppression disk positioned inside the cavity of the ball.

The diameter of the face of the game ball noise suppressor 100 is slightly larger than the diameter of the hollow internal cavity of the ball, further illustrated in FIG. 2. In the case of a volleyball, the face of the game ball noise suppressor 100 is 8.5 inches in diameter, which is approximately 0.5 inch larger than the diameter of the hollow internal cavity of the volley ball within which it is fits. If the game ball noise suppressor 100 is any smaller, its noise suppression ability is ineffective. In part this was due to the fact that smaller game ball noise suppressors were frequently found to be bunched up within an interior area of the cavity after usage. A smaller noise suppressor could also more easily conform to one side of a ball and remain stuck in that position, thereby preventing it from suppressing noise generated in other portions of the ball's interior. Generally, it has been found that the "ping" noise is generated when sound travels back and forth unobstructed from the point of impact, which generates the noise, and the 180 degree opposite side of the ball, which reflects the noise, and thereby creates the harmonic.

If a larger game ball noise suppressor is used, then too much weight is added to the ball. As mentioned above, because the weight of the balls is so strictly regulated, game ball manufacturers may not be able to remove sufficient weight from other components of the ball in order to compensate for the game ball noise suppressor. As there are relatively few components to a ball, this poses an increasingly greater challenge as more and more weight is added by the disk. Most importantly, adding too much weight (through the addition of the game ball noise suppressor) or reducing the weight of the ball by reducing other materials (to compensate for the extra weight of the game ball suppressor) will negatively affect the playability and performance of the ball. This may be demonstrated by the fact that no game ball that includes a cube shaped insert is known to currently be on the market, possibly attesting to the impracticality of this type of solution, as first set forth in Reed et al.

The thickness 110 of the game ball noise suppressor is approximately 3/16 inch. The 3/16 inch thickness provides the greatest rigidity to the game ball noise suppressor without adding excess weight to the ball. A thinner game ball noise suppressor collapses inside the ball resulting in less effective or non-existent sound suppression. Alternatively, a thicker game ball noise suppressor provides no added noise suppression benefit and simply adds unnecessary weight to the ball.

Referring now to FIG. 2, a game ball having a hollow internal cavity 200, formed by a bladder 210 that is contained within an outer playing surface 220, is illustrated. A valve 230 is placed within the bladder 210 and has an access point 240 that extends through the walls of the bladder 210 and the outer playing surface so gas can be inserted into and removed from the game ball. The game ball noise suppressor 100 is fit snuggly within a central area of the hollow internal cavity 200 formed by the bladder 210 of the game ball, but is freestanding. In this context freestanding means that the noise suppressor 100 is not attached to any internal wall of the bladder 210 of the ball, but rather freely stands between the walls because of its slightly larger diameter. After being placed in the ball, the game ball noise suppressor 100 may become concave or wavy in shape as illustrated in FIG. 2, although the degree to which the noise suppressor may bend or wave may be more or less than shown in FIG. 2. Either way, this does not hinder the effectiveness of the noise suppressor and in fact improves its ability to suppress sound waves generated close to the point where an edge of the noise suppressor 100 touches the internal walls of the ball, i.e., sound is not able to travel back and forth at 180 degrees to the opposite side of the ball without hitting the noise suppressor 100. If the noise suppressor 100 was close to the same diameter as the internal cavity and had not crumpled or conformed to one side of the ball, a "ping" noise might be capable of being generated at a point close to the edge of the noise suppressor 100 when sounds waves were reflected back and forth at 180 degree off one internal wall of the bladder to the opposite side, which is needed to create the undesirable resonating "ping" sound. Because the game ball noise suppressor is so light and comes into contact with such a small area of the ball, while unable to move as freely as a cube, it is not felt by a player and does not cause any weight displacement during use.

As is well known in the art, and as briefly described above, when a game ball inflated with a gas mixture containing large, dense molecules is struck by something i.e., a hand, the ground, etc., sound waves are created within the ball and are propagated in typical wave patterns. Low permeability gas mixtures tend to allow sound waves to travel more efficiently and thus create loud "ping" noises not normally heard with the use of just air. In particular, the "ping" inducing noise sound waves must travel back and forth between opposite sides of the ball or bladder in order to produce a frequency resonance audible as a pinging or ringing sound. The game ball noise suppressor 100 of the present invention disrupts the symmetry of the sound waves produced within the cavity thereby suppressing the audible frequency resonance. The game ball noise suppressor 100 does not absorb the sound waves, as is the case with the prior art foam that is attached to the interior side walls of the game ball described in patent application '618,it disrupts the path of the sound waves, and as a result is more effective with less weight added to the ball overall.

The game ball noise suppressor 100 also improves the durability of the sound disruption technology. Reed et al. discloses the use of a cube made of foam, which collides with the inside of the tennis ball as it is in use, causing the foam cube to break down over time and thereby to lose its sound disruption effectiveness. Because the game ball noise suppressor of the present invention is freestanding, but stationary, due to being slightly oversized, and does not move around within the bladder like a free moving and heavier cube would, it will not wear down over time.

Furthermore, the game ball noise suppressor 100 also improves playability. If a player can feel the sound suppression technology moving around within the game ball, the player will not like playing with that particular ball. Even a slight weight displacement within the ball can affect how the ball will play. Reed et al. disclose the use of a cube as a sound suppression device in tennis balls and shows a relatively large cube in comparison to the interior cavity of the ball in which it is contained. A similarly proportioned cube within a volleyball or comparably sized ball, such as a basketball or a kickball, would be quite large thereby adding significant weight to the ball. The greater the weight shifting around the cavity of the ball as it moves, the greater the likelihood that the playability of the ball will be affected.

In addition, the attachment of numerous foam pads within a ball, as disclosed by O'Neill et al., results in undesirable qualities, especially since the pads do not cover the entire interior surface of the ball. As shown by O'Neill et al., three pads are glued to different interior areas of the ball. The weight introduced by the pads is then offset by counter weights. All of these interior changes can affect how the ball feels when it is used, with some parts of the ball feeling firmer or denser than other parts of the ball. In addition, the cost associated with manufacturing game balls with adhered pads will be higher than the cost producing game balls in accordance with the present invention due to the tedious labor involved in manually gluing multiple foam pads through a small hole in the interior of a bladder. Because the foam disk of the present invention sits within the central area of the ball, is light weight, and is unattached to the interior of the ball, it can be easily inserted into the ball or bladder during manufacturing, will not be felt by a player, and does not cause any weight displacement during use. The game ball noise suppressor 100 of the present invention is able to function more efficiently than existing technologies that rely more on sound absorption since it operates on the principle of breaking up the resonating symmetry of sound waves as they bounce back and forth at 180 degrees of the internal wall of the bladder.

As previously noted, the foam disk of the game ball noise suppressor 100 also provides an additional benefit in that it can be quickly and easily inserted into the cavity of the ball during manufacture, thus minimizing added labor costs. A lower cost to produce is a valuable feature. A large disk within the ball would prevent the disk from being compressed below the size of the disk. As a result, the foam disk prevents the ball from being distorted during shipping and storage and from retaining a distorted shape after inflation.

To achieve full advantage of the noise suppression effectiveness of the foam disk without overly increasing the weight of the balls beyond their regulation tolerances, and enabling the balls to be completely inflated with air between sea level and 8,000 feet above, a preferred inflation method according to this invention is set forth below. The use of this method prevents the bladder of the ball from sealing itself shut while also keeping shipping and storage costs to a minimum. To begin with, the exact amount of $SF_6$ to be used in the balls, when combined with air, is determined to create the ultimate $SF_6$ to air ratio. Subsequently, the balls are only partially inflated at the time of manufacture with the $SF_6$ gas, and no air.

Because volleyball inflation pressures are strictly regulated by various leagues and organizations, the precise amount of $SF_6$ added to such balls at manufacture is critical; typically, maximum volleyball inflation pressures are limited to values between 4-6 psig. As a result of testing various gas mixtures at an intermediate elevation, such as Reno, Nev., which is at about 4,000 feet above sea level, at sea level, and at 8,000 feet altitude, it was determined that the exact amount of $SF_6$ to use in the balls while maintaining a partially inflated state, without overly increasing the weight of the balls beyond their regulation tolerances, and enabling the balls to be completely inflated with air between sea level and 8,000 feet above sea level, is 6.24 grams of $SF_6$. The resulting $SF_6$ to air ratio of the present invention, the ratio gas mix range, is approximately 35%/65%. This is the acceptable tolerance range that allows the ball to maintain pressure for extended periods of time. This preferred ratio gas mix range produces an internal pressure in Reno near 5 psig; which decreases to just over 4 psig at sea level, while increasing to no more than 6 psig at 8,000 feet above sea level, generally the highest elevation where such balls are likely to be used.

By partially inflating the balls with only $SF_6$, a number of advantages and goals are achieved. The balls are partially inflated so that the bladders do not seal and so retail store clerks or consumers can more easily inflate the balls completely to their preferred psig official play range at a given altitude level. Because the balls are only partially inflated, they take up substantially less shipping container and warehouse space. Additionally, because the balls are only partially inflated, a pressure gradient between the gas fill inside the balls and the atmosphere outside of the balls does not exist as is the case with balls that are completely filled at manufacture. Hence, there is no $SF_6$ lost between when the balls are manufactured and when they are filled completely at retail. Consequently, the shelf-life of the ball is almost indefinite.

The present invention, while illustrated and described in terms of a preferred embodiment, is not limited to the particular description contained in this specification. For example, the noise suppressor 100 could be utilized in any type of ball, including those without bladders, with equally effective results. Likewise, the partial gas fill at manufacture technique could be used with many other types of balls, although slightly different $SF_6$ to air ratios may be required and more or less $SF_6$ may be required to be partially pre-filled into a ball at the time of manufacture. Additional, alternative or equivalent components and steps could be used to practice the present invention.

What is claimed is:

1. A method for inflating a ball with a mixture of gas, comprising the steps of:

determining a gas mix ratio including an amount of a low permeability gas required to achieve a desired weight and a desired pressure for the ball when the ball is fully inflated at a range of different altitudes, wherein the ball includes an inflatable bladder forming a hollow internal cavity, the ball further including an outer layer surrounding the inflatable bladder and a freestanding, noise suppression disk fit within the inflatable bladder, wherein a diameter of a face of the disk is slightly larger than a diameter of the hollow internal cavity; and partially inflating the ball with the amount of the low permeability gas at a time of manufacture of the ball so the ball can be subsequently fully inflated with air to maintain the desired weight, the gas mix ratio and the desired pressure.

2. The method as recited in claim 1, wherein the ball is a volleyball, wherein the low permeability gas is sulfur hexafluoride, and wherein the amount of the low permeability gas is approximately 6 grams to 6.24 grams.

3. The method as recited in claim 1, further comprising the step of, at the point of retail or use, inflating the ball with an amount of air necessary to achieve the desired weight, the gas mix ratio and the desired pressure.

4. The method as recited in claim 3, wherein the gas mix ratio of the low permeability gas to air is approximately 35/65.

5. The method as recited in claim 1, wherein the disk is formed of a material selected from the group consisting of rubber, leather, a fibrous material, a plasticized material, cardboard, and paper.

6. The method as recited in claim 1, wherein the disk is formed of an open-cell foam.

7. The method as recited in claim 1, wherein the diameter of the face of the disk is approximately 0.5 inch larger than the diameter of the hollow internal cavity.

8. The method as recited in claim 1, wherein a thickness of the disk allows the disk to be flexible but prevents the disk from collapsing completely within the hollow internal cavity.

9. The method as recited in claim 8, wherein the thickness of the disk is approximately 3/16 inch.

10. The method as recited in claim 1, wherein the low permeability gas is sulfur hexafluoride.

11. A method for inflating a ball with a mixture of gas, comprising the steps of:

determining a gas mix ratio including an amount of a low permeability gas required to achieve a desired weight and a desired pressure for the ball when the ball is fully inflated at a range of different altitudes;

inserting a freestanding, noise suppression disk into a hollow internal cavity of the ball at a time of manufacture of the ball, wherein a diameter of a face of the disk is slightly larger than a diameter of the hollow internal cavity of the ball; and partially inflating the ball with the amount of the low permeability gas at the time of manufacture of the ball so the ball can be subsequently fully inflated with air to maintain the desired weight, the gas mix ratio and the desired pressure.

12. The method as recited in claim 11, wherein the ball is a volleyball, wherein the low permeability gas is sulfur hexafluoride, and wherein the amount of the low permeability gas is approximately 6 grams to 6.24 grams.

13. The method as recited in claim 11, further comprising the step of, at the point of retail or use, inflating the ball with an amount of air necessary to achieve the desired weight, the gas mix ratio and the desired pressure.

14. The method as recited in claim 13, wherein the gas mix ratio of the low permeability gas to air is approximately 35/65.

15. The method as recited in claim 11, wherein the disk is formed of a material selected from the group consisting of rubber, leather, a fibrous material, a plasticized material, cardboard, and paper.

16. The method as recited in claim 11, wherein the disk is formed of an open-cell foam.

17. The method as recited in claim 11, wherein the diameter of the face of the disk is approximately 0.5 inch larger than the diameter of the hollow internal cavity.

18. The method as recited in claim 11, wherein a thickness of the disk allows the disk to be flexible but prevents the disk from collapsing completely within the hollow internal cavity.

19. The method as recited in claim 18, wherein the thickness of the disk is approximately 3/16 inch.

20. The method as recited in claim 11, wherein the low permeability gas is sulfur hexafluoride.

* * * * *